US011608661B2

(12) United States Patent
Bishop et al.

(10) Patent No.: US 11,608,661 B2
(45) Date of Patent: Mar. 21, 2023

(54) MOTOR VEHICLE DOOR LOCK

(71) Applicant: Kiekert AG, Heiligenhaus (DE)

(72) Inventors: Bryan Bishop, Walled Lake, MI (US); James A. Svoboda, Byron, MI (US)

(73) Assignee: Kiekert AG, Heiligenhaus (DE)

( * ) Notice: Subject to any disclaimer, the term of this patent is extended or adjusted under 35 U.S.C. 154(b) by 264 days.

(21) Appl. No.: 16/702,644

(22) Filed: Dec. 4, 2019

(65) Prior Publication Data

US 2021/0172220 A1 Jun. 10, 2021

(51) Int. Cl.

| | |
|---|---|
| ***E05B 77/38*** | (2014.01) |
| ***E05B 85/26*** | (2014.01) |
| *E05B 85/02* | (2014.01) |
| *E05B 77/40* | (2014.01) |
| *E05B 81/06* | (2014.01) |
| *E05B 17/00* | (2006.01) |
| *E05B 81/16* | (2014.01) |

(52) U.S. Cl.

CPC ..... *E05B 77/38* (2013.01); *E05B 85/26* (2013.01); *E05B 17/0041* (2013.01); *E05B 17/0045* (2013.01); *E05B 77/40* (2013.01); *E05B 81/06* (2013.01); *E05B 81/16* (2013.01); *E05B 85/02* (2013.01)

(58) Field of Classification Search

CPC ..... E05B 85/02; E05B 85/20; E05B 85/24; E05B 85/243; E05B 85/26; E05B 77/36; E05B 77/38; E05B 77/40; E05B 17/0041; E05B 17/0045; E05B 2015/0403; E05B 2015/0406; E05B 2015/041; Y10T 292/1047; Y10T 292/1082; Y10S 292/23; Y10S 292/53; Y10S 292/54; Y10S 292/56; Y10S 292/57; Y10S 292/61; Y10S 292/73

See application file for complete search history.

(56) References Cited

U.S. PATENT DOCUMENTS

| | | | | |
|---|---|---|---|---|
| 7,401,822 | B2 * | 7/2008 | Graute | E05B 77/38 292/216 |
| 7,503,598 | B2 * | 3/2009 | Graute | E05B 77/40 292/201 |
| 8,348,309 | B2 * | 1/2013 | Patel | E05B 77/38 292/341.12 |
| 10,280,660 | B2 * | 5/2019 | Nozawa | E05C 3/124 |

(Continued)

FOREIGN PATENT DOCUMENTS

| | | | | |
|---|---|---|---|---|
| DE | 10215691 A1 * | 1/2003 | | E05B 77/38 |
| DE | 102011086736 A1 | 5/2012 | | |

(Continued)

*Primary Examiner* — Peter M. Cuomo
*Assistant Examiner* — Noah Horowitz
(74) *Attorney, Agent, or Firm* — Renner, Otto, Boisselle & Sklar, LLP

(57) ABSTRACT

A motor vehicle door lock which is equipped with a locking mechanism substantially comprising a catch and pawl. Furthermore, a locking pin is provided for interaction with the locking mechanism. Furthermore, there is a damping element for a locking mechanism component and/or the locking pin. Finally, the configuration includes at least one spring which is assigned to the locking mechanism. According to the invention, the spring at least partially abuts the damping element.

17 Claims, 3 Drawing Sheets

(56) References Cited

U.S. PATENT DOCUMENTS

| | | | | |
|---|---|---|---|---|
| 2006/0087126 | A1* | 4/2006 | Roussel | E05B 85/26 292/116 |
| 2012/0126549 | A1* | 5/2012 | Papanikolaou | E05B 77/38 292/195 |
| 2020/0056406 | A1* | 2/2020 | Nelsen | E05B 85/045 |

FOREIGN PATENT DOCUMENTS

| | | | | |
|---|---|---|---|---|
| DE | 102018101073 | A1 * | 7/2019 | E05B 83/36 |
| EP | 3048229 | B1 | 7/2016 | |
| EP | 3088643 | B1 | 11/2016 | |
| FR | 2969682 | A1 * | 6/2012 | B60R 21/34 |
| KR | 200330591 | Y1 * | 10/2003 | E05B 77/38 |
| WO | WO-2019038092 | A1 * | 2/2019 | E05B 77/38 |
| WO | WO-2020213199 | A1 * | 10/2020 | E05B 15/02 |

* cited by examiner

MOTOR VEHICLE DOOR LOCK

FIELD OF DISCLOSURE

The invention relates to a motor vehicle door lock, having a locking mechanism substantially comprising a catch and pawl, further having a locking pin for interacting with the locking mechanism, further having at least one damping element for a locking mechanism component and/or the locking pin, and having at least one spring assigned to the locking mechanism component.

BACKGROUND OF DISCLOSURE

The damping element for the locking mechanism component and/or the locking pin generally ensures that movements of the locking mechanism component and/or the locking pin are damped and do not produce bothersome noises. The spring itself ensures that the locking mechanism component in question assumes a defined starting position. For example, once a ratchet engagement with the pawl is released, a catch spring assigned to the catch can ensure that the catch pivots out and releases the previously arrested locking pin. In turn, the function of a pawl spring assigned to the pawl is typically to hold the pawl against the catch, in order to ensure that it correctly assumes a locking position and/or ratchet position starting from an open position of the locking mechanism.

The generic prior art according to EP 3 088 643 B1 relates to a locking device for a vehicle door. In this context, a rubber cushion is provided as a damping element for a locking bracket and/or locking pin. The rubber cushion is installed for this purpose in an inlet opening and/or an insert groove of a latch housing. For this purpose, the latch housing has a fitting opening.

The further prior art according to EP 3 048 229 B1 also relates to a locking device for a vehicle. In this case as well, a latch housing is provided to accommodate the damping element and/or a shock absorber. The damping element has a relatively complex design with different molded rods and/or components and functions to dampen not only the locking pin, but also the pawl and/or a locking mechanism. DE 10 2011 086 736 A1 proceeds in a comparable manner.

The prior art has generally proven itself when it comes to acoustically dampening noises of locking mechanism components and/or the locking pin during operation. However, during the operation of a motor vehicle door lock, it is not only the locking mechanisms or the locking pin which are responsible for unwanted noise; the spring assigned to the locking mechanism is also frequently a cause. This can be attributed to the fact that, during operation, the spring in question generates "creaking" noises as a result of friction. Since motor vehicle door locks typically have a latch housing and/or a corresponding latch cover mostly made of plastic, and additionally have a latch case made of steel in which the latch mechanism is mounted, the latch case in turn being fixed in or on a motor vehicle door, the vehicle door in question and/or its space which is enclosed by an outer door panel and inner door panel acts like a resonator for such creaking noises. As a result, such creaking noises are considered disadvantageous.

So far, attempts have been made in practice to reduce the friction of the springs assigned to the locking mechanism by applying lubricant such as grease or oil, to thereby suppress the creaking noises described above. However, such a "greasing" of the springs comes with several disadvantages. First of all, the lubricant in question must be applied during assembly, and this is often quite simply "forgotten." In addition, such lubricants do not maintain their lubricating function in all circumstances—especially considering that motor vehicle door closures, like the associated motor vehicles, are exposed to a wide range of temperatures and moisture.

For example, motor vehicles are operated in the temperature range of from about −50° C. to +80° C. To effectively suppress the mentioned creaking noises, a lubricant must cover this temperature range. In addition, such lubricants tend to "gum" as a result of aging, and consequently stop completely or partially to perform their friction-reducing function. Quite apart from these considerations, the application of the lubricant during assembly is a cost factor. The invention aims to provide a remedy for these concerns.

SUMMARY OF DISCLOSURE

The invention is based on the technical problem of further developing such a motor vehicle door lock such that noises of the spring assigned to the locking element are effectively and permanently suppressed in the simplest possible manner.

To solve this technical problem, a generic motor vehicle door lock is characterized in the scope of the invention in that the spring at least partially abuts the damping element.

As a rule, the spring has at least one coiled section. The outer circumference of this winding section of the spring usually abuts the damping element. The spring is typically a torsion spring. This torsion spring comprises the coiled section and two legs connected thereto.

The design is implemented in such a manner that one leg of the torsion spring is supported on or in the latch housing or on or in the latch case. The other leg acts on the locking mechanism component. If the locking mechanism component is pivoted, the spring and/or torsion spring is tensioned and ensures that, after completion of the pivoting movement, the locking mechanism component returns to its original position.

Advantageously, the damping element has at least one arcuate segment which interacts frictionally with the coiled section of the spring and/or torsion spring. That is, the coiled section of the spring and/or torsion spring abuts the arcuate segment of the damping element with friction. As a consequence thereof, during a pivoting movement of the locking mechanism component which the spring acts on, the coiled section of the spring and/or the individual windings of the coiled section of the spring glide along the arcuate segment with friction. Since it is advantageous for the damping element to be made of plastic, and in particular elastomeric plastic, the previously mentioned "creaking" noises of the spring are effectively suppressed in this way.

In fact, these creaking noises are mainly caused by the fact that the individual windings of the coiled section of the spring and/or torsion spring move relative to each other and/or against each other with friction. In addition, during this process and/or during a pivoting movement of the locking mechanism component, and consequently the associated action of the spring, the individual windings of the coiled section may assume different diameters. All these effects are suppressed according to the invention in that the coiled section and/or the individual windings have a interact with the arcuate segment of the damping element in a manner producing friction.

The design is additionally implemented in such a manner that the arcuate segment has a height and/or material thickness which is adapted to the axial length of the coiled section. In this way, the invention ensures that each individual winding of the coiled section of the spring and/or torsion spring abuts the arcuate segment.

Due to the friction of the respective windings on the arcuate segment, there is no relative movement between the individual windings when the locking mechanism component, acted upon by the spring, is deflected and/or executes a pivot movement. In addition, no changes of diameter are observed. As a result, it is likely that all windings of the coiled section of the spring and/or torsion spring will move evenly and be damped by means of the damping element. In addition, each winding assumes the same diameter. There are no relative movements between the windings, and no resulting friction. The overall result is that the previously mentioned "creaking noises" are suppressed.

This approach also relies on a damping element for the locking mechanism component and/or the locking pin, said damping element already necessarily present—such that no additional assembly steps are required. In addition, the damping element is designed in such a manner that its effect is observed over the entire temperature range indicated above, and is more or less constant, such that the suppression of creaking noises is observed in all conceivable conditions of use according to the invention. Finally, the aging behavior of such damping elements is low and/or manageable, suppressing the formation of any creaking noises—even on long time scales of several decades, for example. The essential advantages arise from this realization.

According to a further advantageous embodiment, the design is implemented in such a manner that the damping element is inserted into a pocket of the latch housing. This pocket generally has an opening which is the result of the manufacturing process. According to the invention, the damping element ensures that said opening of the pocket is closed off and sealed by means of the damping element. This means that the damping element assumes a threefold function within the scope of the invention.

First, the damping element ensures that the locking mechanism component and/or the locking pin is damped during its movement. It is of course also possible that the damping element dampens a plurality of locking mechanism components, and/or one locking mechanism component and additionally the movement of the locking pin. In addition, and as a further function, the damping element according to the invention provides for the described friction damping of the spring assigned to the locking mechanism component, and thus prevents the creaking noises previously observed in the prior art. Finally, as the third function, the damping element ensures that the opening in the pocket, resulting from the manufacturing process, in which the damping element is accommodated in a manner providing a seal, is closed off and sealed. In this way, the damping element ensures that the interior of the latch housing is protected from any dirt or water entering the same.

The damping element is advantageously a locking pin damping element—that is to say, a damping element by means of which the movement of the locking pin is damped. The locking pin usually travels via an inlet opening into a motor vehicle door latch as part of the motor vehicle door lock. For this purpose, the locking pin damping element is advantageously arranged at the end of the inlet opening in the latch housing.

In order to anchor the damping element properly in the latch housing, in the previously mentioned pocket, the damping element usually has external moldings, optionally for interaction with indentations in the latch housing. The interaction between the external moldings of the damping element and the indentations in the latch housing ensures that the damping element is captively accommodated in the latch housing in a precise position.

The result is an inventive motor vehicle door latch which operates with a multi-functional damping element. In fact, the function of this damping element is not only that of suppressing the noise of the locking mechanism component and/or the movement of the locking pin; rather, the damping element additionally assumes the function of acting frictionally on the spring assigned to the locking mechanism component. For this purpose, an arcuate segment of the damping element typically acts on the coiled section of the spring—specifically in an interaction which applies friction. As a result, any creaking noises of the spring are effectively suppressed. All of this is achieved by making use of a component which must be included in the configuration anyway—namely, the damping element—without an additional assembly step. The essential advantages arise from this realization.

BRIEF DESCRIPTION OF DRAWINGS

The invention will be explained in more detail below with reference to an exemplary embodiment; wherein.

DETAILED DESCRIPTION

Figure 1:
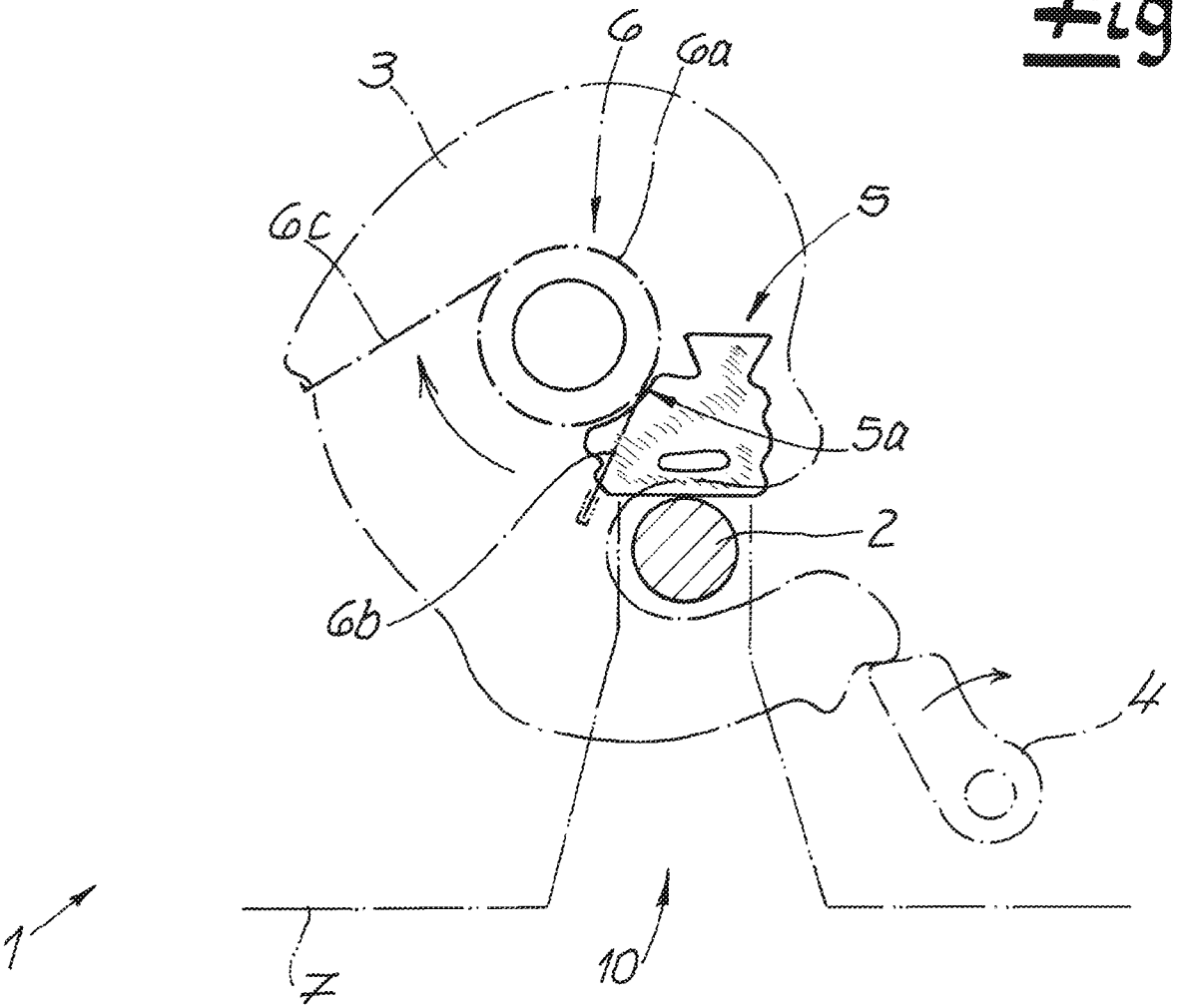
FIG. 1 shows the motor vehicle door lock according to the invention, in an overview.
Figure 2:
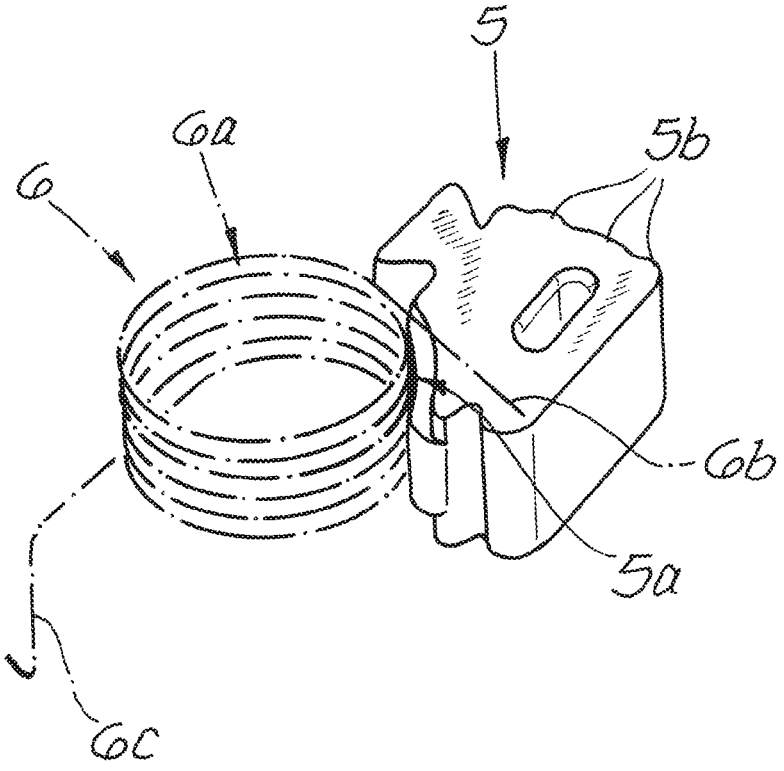
FIG. 2 shows a detail view of the damping element according to FIG. 1.

The figures show a motor vehicle door lock which is composed substantially of a motor vehicle door latch 1 arranged on or in a motor vehicle door, on the one hand, and also a locking pin 2 arranged on the vehicle body. In principle, the configuration can also be reversed. Very generally, the motor vehicle door equipped with the motor vehicle door lock described below can be a side door, a tailgate, a front hood, a sliding door, a tank hatch or loading hatch, etc.

The motor vehicle door lock and/or the motor vehicle door latch 1 has, in its basic structure, a locking mechanism 3, 4 substantially comprising a catch 3 and a pawl 4 interacting with the same. At least one damping element 5 is additionally included. The damping element 5 can generally interact with a locking mechanism component 3, 4 and/or the locking pin 2. According to the exemplary embodiment, the design is implemented in such a manner that the damping element 5 is a locking pin damping element 5—that is, a damping element 5 which interacts with the locking pin 2.

Finally, the basic structure also includes at least one spring 6 assigned to the locking mechanism component 3, 4. In the figure, the spring 6 is a catch spring 6—i.e., a spring 6 which is assigned to the catch 3. The spring and/or catch spring 6 specifically ensures that the catch 3 executes the pivoting movements indicated in FIG. 1 in the clockwise direction to release the locking pin 2 as soon as the pawl 4 is lifted from the catch 3. Starting from the closed position of the locking mechanism 3, 4 shown in FIG. 1, an opening of the locking mechanism 3, 4 can be brought about by the pawl 4 being lifted off the catch 3 about its axis by a clockwise movement, likewise indicated in FIG. 1, so that subsequently the catch 3 can pivot about its axis in the indicated clockwise direction. As a result, the previously captive locking pin 2 is released. The rotation of the catch 3 occurs about its axis and/or axis of rotation, which is also arranged centrally in relation to the spring and/or catch spring 6.

The spring and/or catch spring 6 in the exemplary embodiment is a torsion spring. It has a coiled section 6*a* and legs 6*b*, 6*c* connected thereto. The design is such that one leg 6*b* of the spring 6 abuts a latch housing 7, while the other leg 6*c* of the spring 6 overlaps the catch 3 with its uncoiled end and/or abuts the catch 3 by the outer circumference thereof. As a result, a closing movement of the catch 3 in a counterclockwise direction causes the spring and/or catch spring 6 to be tensioned.

In order not to cause "creaking" noises in the spring 6, in particular upon such a tensioning movement of the spring and/or catch spring 6, the spring 6 at least partially abuts the damping element 5. In fact, the design is implemented in such a manner that the spring 6, with at least the coiled section 6*a*, abuts the damping element 5 on its outer circumference. For this purpose, the damping element 5 has an arcuate segment 5*a*.

The overall design is such that the arcuate segment 5*a* has a radius which matches the radius of the coiled section 6*a* of the spring 6. This results in a high-surface-area abutment of the coiled section 6*a* of the spring 6 against said arcuate segment 5*a* as a component of the damping element 5. This is additionally ensured by the fact that the material thickness of the arcuate segment 5*a* of the damping element 5 matches an axial length of the coiled section 6*a* of the spring 6. In this way, the invention ensures that all windings of the coiled section 6*a* of the spring 6 abut the arcuate segment 5*a* of the damping element and/or locking pin damping element 5 at the same time.

Figure 3:
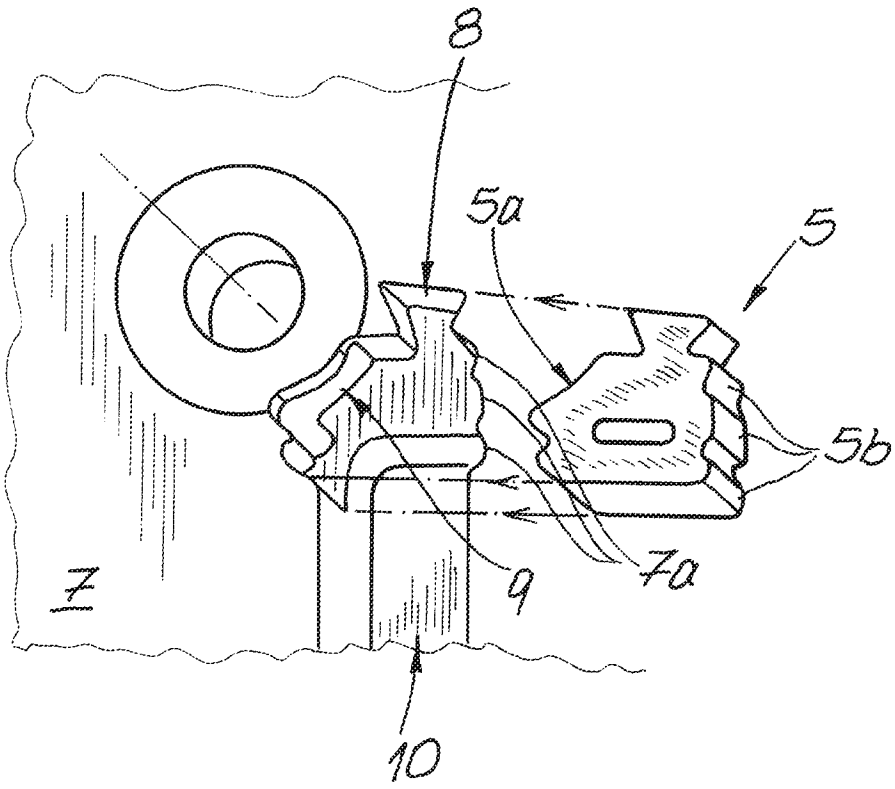
FIG. 3 shows a detail of the latch housing in the pocket region.

A comparative examination of FIGS. 1 and 3 shows that the damping element and/or locking pin damping element 5 is accommodated as a whole in a pocket 8 of the latch housing 7. The pocket 8 has an opening 9 which is the result of the manufacturing process. According to the invention, the opening 9 can now be closed off and sealed by means of the damping element 5. This ensures that any water, dust or dirt that penetrates into the motor vehicle door latch 1 via an inlet opening 10 cannot penetrate into the interior of the latch housing 7. As such, levers, drive motors, etc. configured in this location are protected from such external influences.

In addition, it can be seen from FIGS. 1 and 3 that the locking pin damping element 5 is arranged at the end of said inlet mouth 10 in the latch housing 7. The damping element 5 has external moldings 5*b* to hold it in the latch housing 7, which interact with—and/or can interact with—associated indentations 7*a* in the latch housing 7. In this way, the damping element 5 can be anchored in the interior of the latch housing 7 in a precise position at the end of the inlet mouth 10.

The damping element 5 is usually made of plastic. An elastomeric plastic is most commonly used in this case. Plastics such as NBR (acrylonitrile-butadiene rubber), EPDM (ethylene-propylene rubber), SBR (styrene-butadiene rubber) or the like are possibilities, and are used.

LIST OF REFERENCE NUMBERS

1 motor vehicle door latch and/or motor vehicle door lock
2 locking pin
3 catch
4 pawl
3, 4 locking mechanism
5 damping element
5*a* arcuate segment
6 spring and/or catch spring
6*a* coiled section
6*b*, 6*c* legs
7 latch housing
7*a* indentations
8 pocket
9 opening
10 inlet opening

The invention claimed is:

1. A motor vehicle door lock comprising:
a locking mechanism having a catch and a pawl;
a locking pin for interacting with the locking mechanism;
at least one damping element for a locking mechanism component of the locking mechanism and/or the locking pin; and
at least one spring for the locking mechanism component, wherein the at least one spring at least partially abuts directly against the at least one damping element; and
wherein the at least one spring has a coiled section that abuts directly against the at least one damping element via an outer circumference of the coiled section.

2. The motor vehicle door lock according to claim 1, wherein the at least one spring is a torsion spring comprising the coiled section and legs connected thereto.

3. The motor vehicle door lock according to claim 1, wherein the at least one damping element has at least one arcuate segment which interacts frictionally with the coiled section.

4. The motor vehicle door lock according to claim 1, wherein the at least one damping element is inserted into a pocket of a latch housing.

5. The motor vehicle door lock according to claim 4, wherein an opening of the pocket is closed off and sealed by the at least one damping element.

6. The motor vehicle door lock according to claim 1, wherein the at least one damping element further is a locking pin damping element that is arranged in a latch housing at an end of an inlet mouth that receives the locking pin, and that abuts directly against the locking pin when the locking pin is positioned in the inlet mouth.

7. The motor vehicle door lock according to claim 1, wherein the at least one damping element has external moldings for interaction with indentations in a latch housing.

8. The motor vehicle door lock according to claim 1, wherein the at least one damping element is made of a plastic.

9. The motor vehicle door lock according to claim 8, wherein the at least one damping element is made of an elastomeric plastic.

10. The motor vehicle door lock according to claim 1, wherein the at least one spring is configured pivot the catch to release the locking pin.

11. The motor vehicle door lock according to claim 1, wherein the at least one spring and the catch are arranged around a same axis of rotation.

12. The motor vehicle door lock according to claim 2, wherein the legs includes a first leg that abuts a latch housing and a second leg that abuts the catch.

13. The motor vehicle door lock according to claim 3, wherein the arcuate segment has a radius that matches a radius of the coiled section of the spring.

14. The motor vehicle door lock according to claim 3, wherein a thickness of the arcuate segment is at least equal to an axial length of the coiled section of the spring whereby all windings of the coiled section abut the arcuate segment.

15. The motor vehicle door lock according to claim 4, wherein the at least one damping element is wholly accommodated in the pocket of the latch housing.

16. The motor vehicle door lock according to claim 1 further comprising a latch housing, wherein the at least one damping element is anchored in an interior of the latch housing via interlocking features formed on the at least one damping element and the latch housing.

17. The motor vehicle door lock according to claim 1, wherein the at least one damping element is formed as a single continuous body.

* * * * *